US011112213B1

(12) United States Patent
Gieseke

(10) Patent No.: US 11,112,213 B1
(45) Date of Patent: Sep. 7, 2021

(54) LAUNCH SPEED MULTIPLIER

(71) Applicant: The United States of America as represented by the Secretary of the Navy, Newport, RI (US)

(72) Inventor: Thomas J Gieseke, Warren, RI (US)

(73) Assignee: United States of America as represented by the Secretary of the Navy

( * ) Notice: Subject to any disclaimer, the term of this patent is extended or adjusted under 35 U.S.C. 154(b) by 0 days.

(21) Appl. No.: 16/784,280

(22) Filed: Feb. 7, 2020

(51) Int. Cl.
*F41F 3/10* (2006.01)
*F41B 11/73* (2013.01)

(52) U.S. Cl.
CPC ..... *F41F 3/10* (2013.01); *F41B 11/73* (2013.01)

(58) Field of Classification Search
CPC ... F41F 3/10; F41B 11/00; F41B 11/70; F41B 11/73; F41B 11/80
USPC ..... 124/56, 61, 71; 89/7
See application file for complete search history.

(56) References Cited

U.S. PATENT DOCUMENTS

| | | | | |
|---|---|---|---|---|
| 3,421,718 | A * | 1/1969 | Gehringer | B64F 1/06 244/63 |
| 3,460,430 | A * | 8/1969 | Fisher | F41F 3/04 89/1.818 |
| 4,333,382 | A * | 6/1982 | Holt | F41F 3/06 89/1.806 |
| 6,318,350 | B1 * | 11/2001 | Williams | A01M 31/00 124/71 |
| 2010/0037878 | A1 * | 2/2010 | Leinbach | F41B 7/00 124/16 |
| 2017/0297741 | A1 * | 10/2017 | Verho | B64F 1/06 |

* cited by examiner

*Primary Examiner* — Bret Hayes
(74) *Attorney, Agent, or Firm* — James M. Kasischke; Michael P. Stanley

(57) ABSTRACT

An adapter cage is provided for a compressed gas launcher to multiply launch velocity. Kinematics of wheels integral to the adapter cage results in a doubling of the pusher plate velocity as that motion is imparted on a light-weight launch vehicle. The wheels of the adapter cage can press against the launch vehicle and the wheels are pressed against the walls of the launcher for employing friction at the interface of the wheels and the inner surface of the launcher to transfer motion to force out a muzzle cap of the launcher and to enable launch of the launch vehicle.

6 Claims, 7 Drawing Sheets

LAUNCH SPEED MULTIPLIER

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention relates to a gas propelled mechanical launcher.

(2) Description of the Prior Art

There is an ongoing need for the development of high-speed vehicles for a range of applications. As such, launchers are required to accelerate those vehicles from rest to a high velocity. One type of launcher system for the launch of small devices is a gas propelled canister launcher. Canister launchers are well known in the art.

The basic construction of a gas propelled launcher is a tube divided into two sections by a piston, also referred to as a pusher plate. On one side of the pusher plate is the launch vehicle in a launcher volume and on the other side of the pusher plate is a void or breech chamber that can be rapidly filled with compressed air (from a reservoir or gas generator). The expansion of the compressed air is capable of forcing the pusher plate to launch the vehicle out of the launcher.

The rate of gas release into the volume behind the pusher plate is designed to maximize the transfer of energy to the launch vehicle while controlling the acceleration of the launch vehicle. Gas propelled canister launchers are designed for a specific mass vehicle and acceleration profile. If there is a need to launch a lighter vehicle from the same launcher (at a higher exit velocity), and the original launch vehicle is replaced with a light weight vehicle; the system performance will be poor. The poor performance is because the light weight vehicle will be accelerated rapidly and the flow of gas into the volume behind the pusher plate will be incomplete. Unless the gas supply system is redesigned; the launcher will perform sub-optimally.

A solution to adapt to varying launch vehicles would be to modify an existing launcher system with an adapter assembly or mechanism that increases launch exit velocity while maintaining the pusher plate design acceleration profile and without altering the gas supply dynamics. Provided that the total assembly (the adapter assembly plus the launch vehicle) is lighter than the standard heavier payload; the exit velocity can be increased to take advantage of the available launch energy.

Based on the state of the prior art, an improved apparatus is needed that can be used to modify a gas generator canister launcher so that light weight vehicles can be launched at high velocity from the launcher without requiring the redesign of the gas generator system.

SUMMARY

It is therefore a primary object and general purpose of the present invention to provide an adapter apparatus for launching a stationary launch vehicle or projectile from rest to a prescribed exit velocity.

It is a still further object of the present invention to provide an adapter apparatus for imparting a linear velocity to a launch vehicle or projectile that exceeds the linear velocity of a pusher plate of a launcher.

To attain the objects of the present invention, an adapter assembly for a compressed gas launcher is provided for use with high-speed projectiles or launch vehicles. The inventive adapter assembly allows forces applied to the pusher plate to be transferred to the launch vehicle.

The adapter assembly includes rollers that engage an inner surface of the cylindrical launcher and the outer surface of the launch vehicle. With the adapter assembly, the effective mass of the launch assembly, as experienced by the pusher plate, can remain constant while the exit velocity of a replacement lighter weight vehicle is increased.

The adapter cage of the assembly comprises three or more rails, connected by two circumferential frames, positioned in the annulus between the outer surface of the launch vehicle and the inner diameter of the launch tube. A first circumferential frame connected to an end of each of these rails is in contact with the pusher plate. An array of wheels are attached to the rails, spaced uniformly along the length of each rail, with rotational axes aligned with the circumference of the annular region. The wheels along each rail are linked together with coupling rods.

The launch vehicle would be positioned in the center of the adapter cage. A muzzle closure cap covers the end of the launch tube and is held in place with sheer pins. Seals are also in place to prevent the low of water from outside of the launch tube into the launcher volume.

To launch the launch vehicle, compressed air is released into the breech chamber from a compressed air canister or tank. Forces on the pusher plate are transferred through the adapter cage and onto the muzzle closure cap. Because the adapter cage wheels are in contact with the inner surface of the launch tube; frictional forces cause the wheels to rotate. The wheels are also positioned to be in contact with the outer surface of the launch vehicle. The wheel rotation transfers forces to the launch vehicle and causes the launch vehicle to move longitudinally toward the muzzle closure cap. When the pusher plate moves toward the end of the launch tube, the launch vehicle will reach the end of the adapter assembly which then forces out the muzzle cap. When the movement force exceeds the failure strength of the sheer pins; the pins fail and the pusher plate moves longitudinally. The launch vehicle then exits the launcher and continues under power.

Because the velocity of the outer surface of the wheels is zero at a no-slip condition on the inner surface of the launch tube and the hub velocity of the wheels is equal to the pusher plate and cage velocity; the inner surface of the wheels at the surface of the launch vehicle will be twice the velocity of the pusher plate and cage velocity. Similarly, the net force exerted on the launch vehicle will be one half of the net force exerted by the pusher plate on the adapter cage.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Systems and techniques exist for launching a projectile from rest. The present invention fits into this general category of device but employs a novel set and arrangement of components. These components allow the projectile to be accelerated to a higher velocity.

Figure 1:
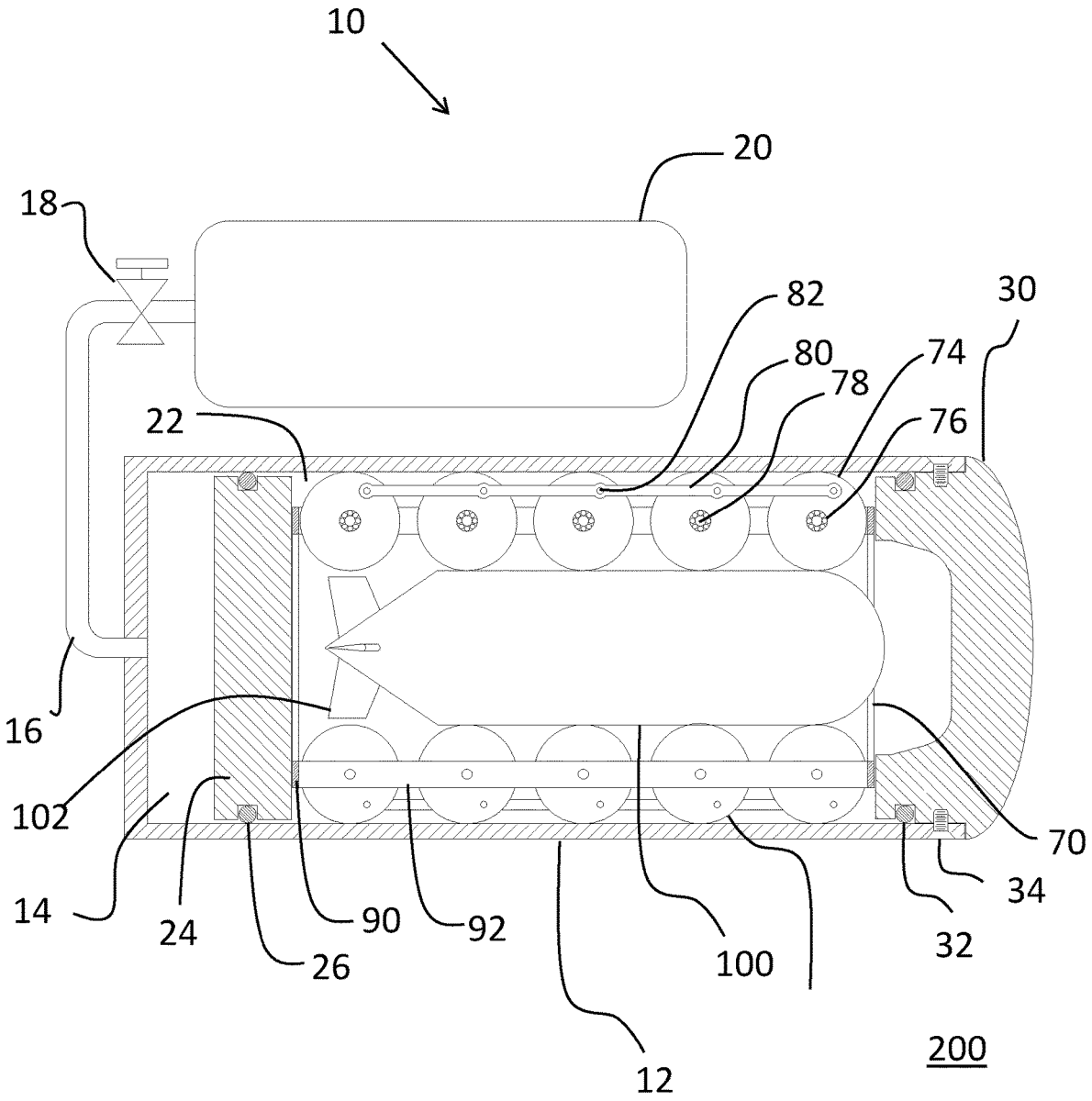
FIG. 1 depicts a cross-section of the adapter assembly of the present invention viewed with the launcher system.

Referring now to the figures, FIG. 1 depicts a launcher system 10 of the present invention viewed along the side of a launch vehicle 100. A launch tube 12 of the launcher system 10 is divided into two sections. A first section is the breech chamber 14 which is fed by an air line 16 connected via a servo valve 18 to an air supply tank 20. A second section is the launch tube volume 22. The breech chamber 14 and the launch tube volume 22 are separated by a pusher plate 24. The pusher plate 24 includes a seal 26 around a circumference in which the seal isolates the breech chamber 14 from the launch tube volume 22.

A muzzle closure cap 30 is fitted into the open end of the launch tube 12. A seal 32 on the muzzle closure cap 30 isolates the launch tube volume 22 from the environment 200. Multiple shear pins 34 are distributed around the circumference of the launch tube 12 between the muzzle closure cap 30 and the launch tube 12. The launch vehicle 100 can be centered in the launch tube volume 22.

In use, an adapter cage assembly 70 is positioned in the annulus formed between an outer surface of the launch vehicle 100 and the launch tube 18. The adapter cage assembly 70 comprises motion transfer wheels 74 with integral bearings 76, motion transfer wheel axles 78, linkage bars 80, linkage bar pins 82 and an adapter cage 90. A first end surface of the adapter cage 90 rests on the pusher plate 24 and a second end surface presses against the muzzle closure cap 30.

Figure 2:
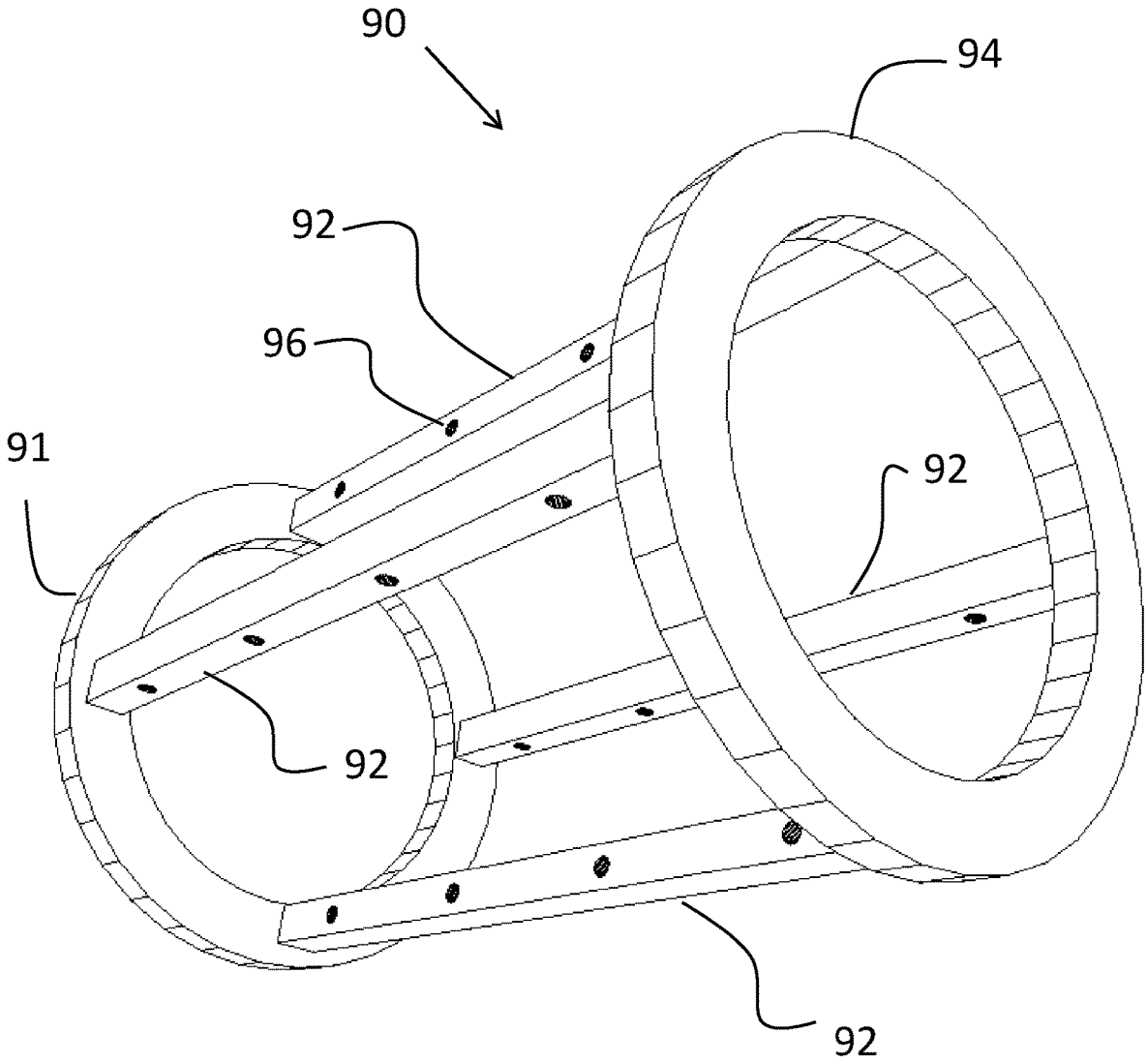
FIG. 2 depicts a perspective view of the adapter of the present invention.

FIG. 2 shows details of the adapter cage 90. The adapter cage 90 comprises a first circumferential ring 91 as the first end surface, multiple longitudinal rails 92, and a second circumferential ring 94 as the second end surface. The first circumferential ring 91 and the second circumferential ring 94 lie in planes parallel to each other and are centered on a central axis of the launch vehicle 100. The longitudinal rails 92 include axle mounting holes 94.

Returning to FIG. 1, a plurality of the motion transfer wheels 74 are attached to the longitudinal rails 92 of the adapter cage 90 through mounting holes 96 (shown in FIG. 2) by the motion transfer wheel axles 78. The motion transfer wheels 78 include the integral bearings 76.

The linkage bar 80 connects the transfer wheels 74 which are attached to a common longitudinal rail 92. Each longitudinal rail 92 has an associated linkage bar 80 with the linkage bar connecting the motion transfer wheels 74 by the linkage bar pins 82 associated with a common longitudinal rail so that the motion transfer wheels attached to the common rail rotate in tandem.

Figure 3:
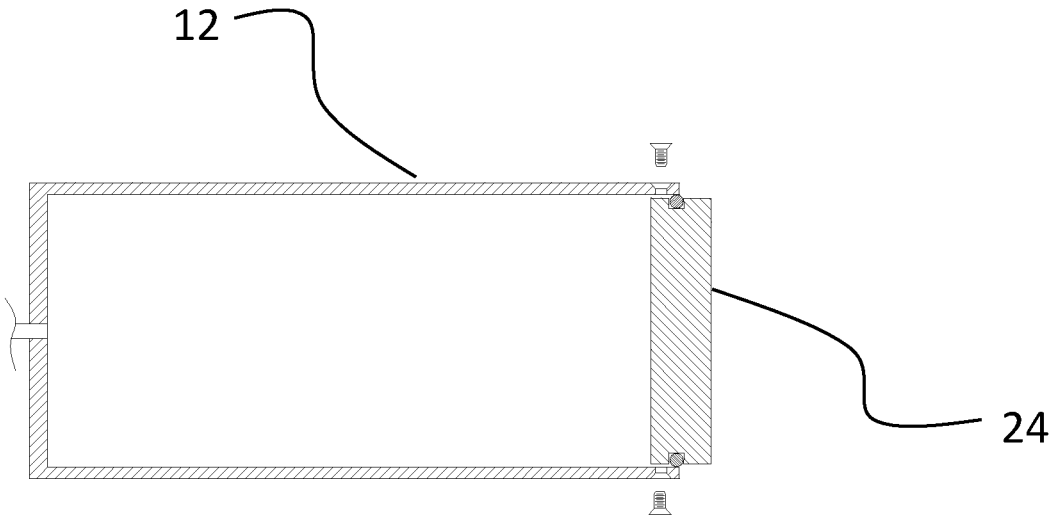
FIG. 3 depicts the launch tube and pusher plate of the launcher system.
Figure 4:
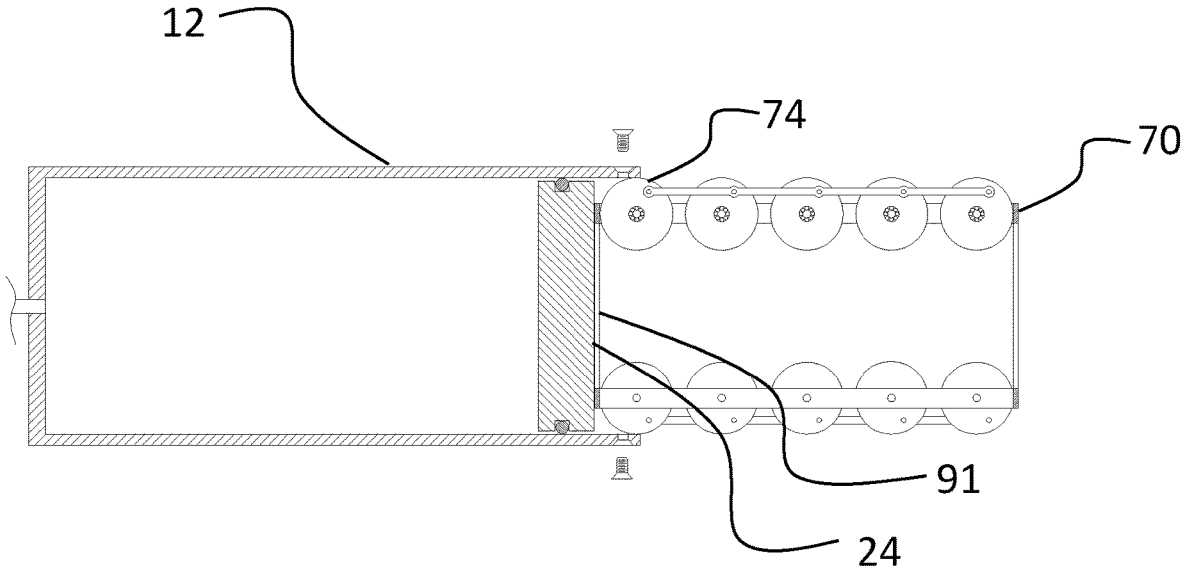
FIG. 4 depicts the launcher system in a first phase of projectile loading.

To load the launch vehicle 100 into the launcher system 10, the pusher plate 24 is first pressed into the muzzle end of the launch tube 12 as depicted in FIG. 3. The adapter cage assembly 70 is then positioned for loading as depicted in FIG. 4. The first circumferential ring 91 of the adapter cage 90 is positioned in contact with the pusher plate 24 (the surface facing the launch vehicle volume) such that the first set of motion transfer wheels 74 contacts the inner surface of the launch tube 12.

The width of the adapter cage assembly 70 (adapter cage 90 with the motion transfer wheels 74 attached) is slightly larger than the inner diameter of the launch tube 12. The motion transfer wheels 74 are slightly compressed during the insertion of the adapter cage assembly 70 into the launch tube 12 to produce frictional forces between the motion transfer wheels and the inner diameter of the launch tube. To allow this compression, the motion transfer wheels 74 are manufactured from a compressible material such as polyurethane.

Figure 5:
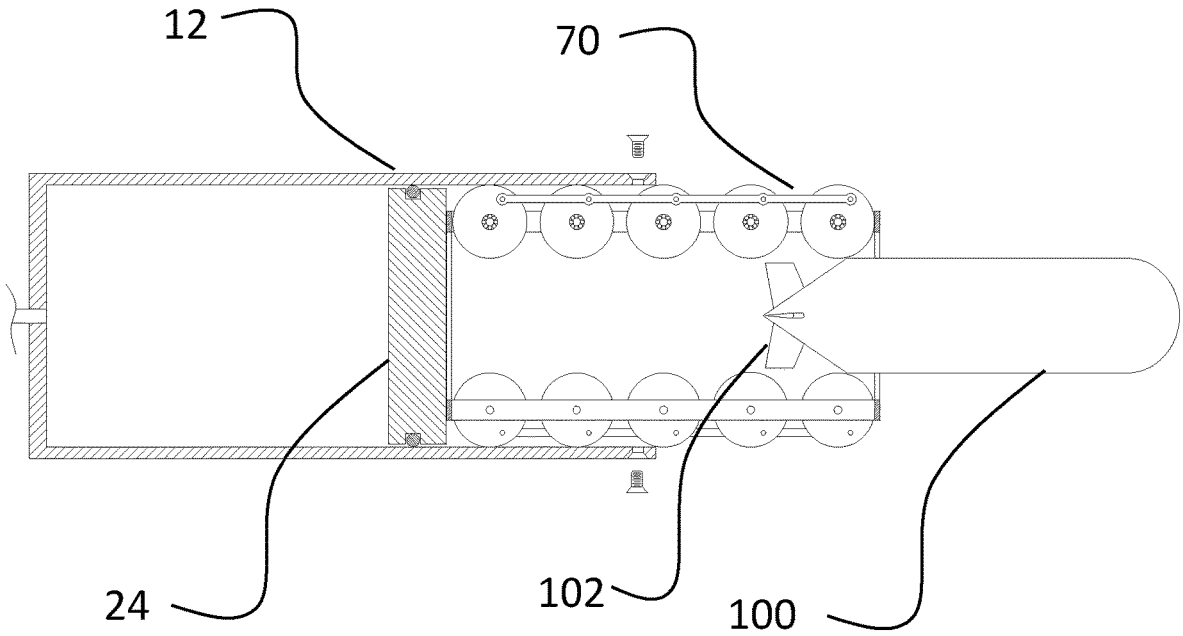
FIG. 5 depicts the launcher system in an intermediate phase of projectile loading when the projectile is at a maximum longitudinal extent of engagement with the adapter assembly.

As depicted in FIG. 5, the launch vehicle 100 is loaded into the adapter cage assembly 70 by feeding the launch vehicle axially (launch vehicle tail 102 first) into the center of the adapter cage assembly 70 between the motion transfer wheels 74. The total width of the space inside of the adapter cage assembly 70, between the motion transfer wheels 74, is slightly smaller than the outer diameter of the launch vehicle 100.

As the launch vehicle 100 is pressed into the adapter cage assembly 70; the launch vehicle engages the motion transfer wheels 74. When the launch vehicle 100 engages the motion transfer wheels 74; the motion transfer wheels are slightly compressed to produce large frictional forces between the motion transfer wheels and the outer diameter of the launch vehicle.

Figure 6:
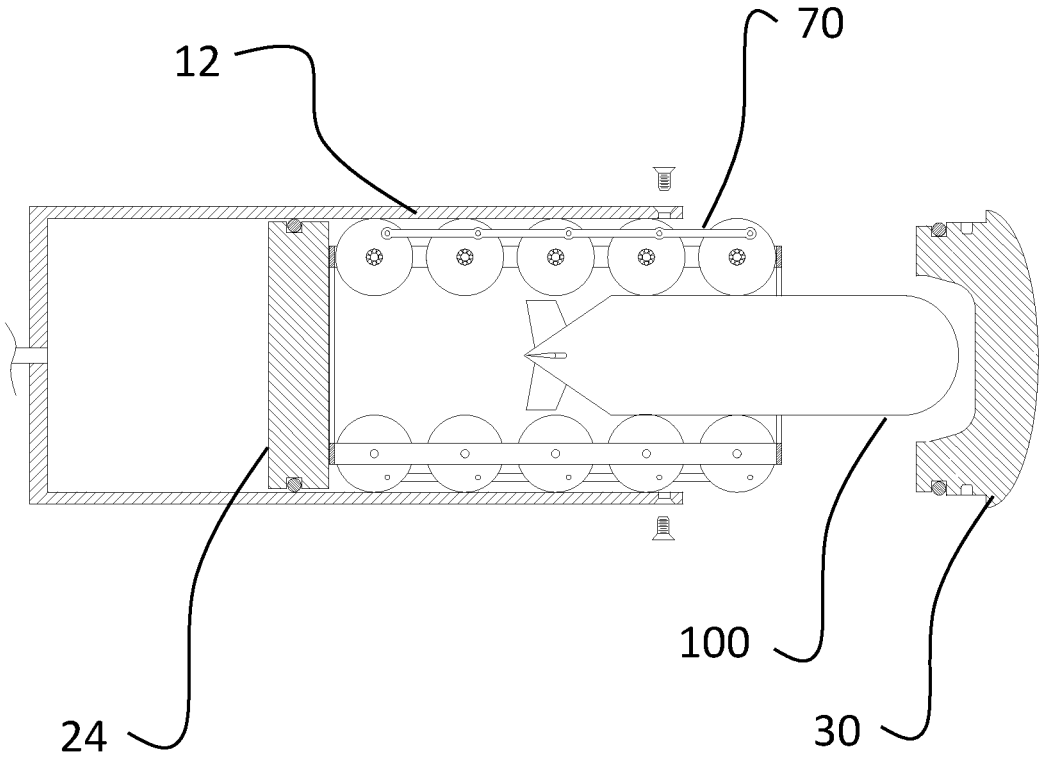
FIG. 6 depicts the launcher system in an intermediate phase of projectile loading with a muzzle cap of the launch system shown.

As depicted in FIG. 6, as the launch vehicle 100 is inserted further into the adapter cage assembly 70, the adapter cage assembly and pusher plate 24 are forced into the launch tube 12 toward the breech chamber 14 through the action of the linked motion transfer wheels 74 and their engagement with the launch tube.

Figure 7:
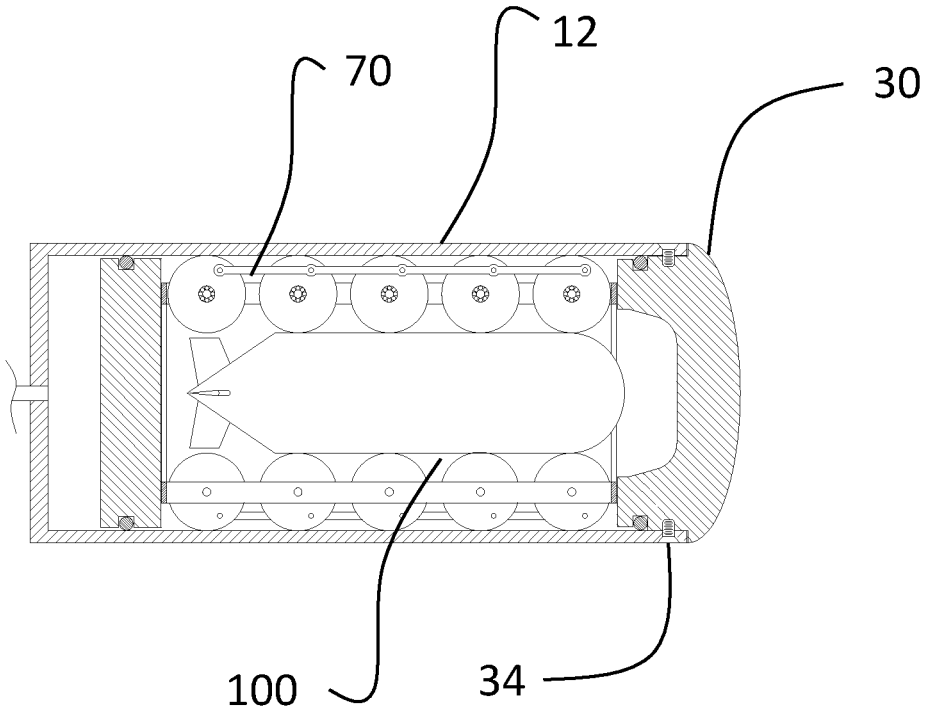
FIG. 7 depicts the launcher system in a final phase of projectile loading and first phase of projectile launch when the projectile is at rest and in a pre-launch position.

When the launch vehicle 100 and adapter cage assembly 70 are fully retracted into the launch tube 12, as depicted in FIG. 7, the muzzle closure cap 30 is pressed into the open end of the launch tube and the shear pins 34 are inserted through the launch tube to secure the muzzle closure cap in place.

The launch process is initiated by opening the servo valve 18 to allow compressed air to flow through the air line 16 from the air supply tank 20 into the breech chamber 14. As pressure rises in the breech chamber 14; force is transferred through the pusher plate 24 and the adapter cage 90 to the muzzle closure cap 30. When the force exceeds the failure strength of the shear pins 34 and the shear pins fail; the pusher plate 24 and adapter cage 90 then force the muzzle closure cap 30 off the end of the launch tube 12.

Further expansion of gasses in the breech chamber 14 force the pusher plate 24 and adapter cage assembly 70 along the axis of the launch tube 12, as depicted in FIG. 6. The motion transfer wheels 74 are in contact with the inner surface of the launch tube 12 during the launch process.

Frictional forces create a no slip condition at the contact point between the motion transfer wheels 74 and the inner surface of the launch tube 12. As the adapter cage assembly 70 is forced longitudinally along with the central axis of the motion transfer wheels 74; the motion transfer wheels and the outer surface of the launch vehicle 12 are forced longitudinally at twice the rate as the adapter cage assembly 70. The launch vehicle 12 motion continues longitudinally until the launch vehicle is no longer in contact with the motion transfer wheels 74 at which time the launch vehicle continues under power.

It will be understood that many additional changes in the details, materials, steps and arrangement of parts, which have been herein described and illustrated in order to explain the nature of the invention, may be made by those skilled in the art within the principle and scope of the expressed in the appended claims.

What is claimed is:

1. An adapter assembly for use in a compressed air-actuated launcher in which the launcher includes a cylindrical launch tube with an inside diameter and having a closed end and an open end with the launcher capable of accelerating a launch vehicle from rest to launch, said adapter assembly comprising:

an adapter cage having a first ring positioned coaxially to the launch tube of the launcher and to be in contact with a pusher plate of the launcher within a volume of the launch tube, a second ring coaxially facing said first ring and in contact with a muzzle cap of the launcher and said second ring having an inner diameter and an outer diameter equal to an inner diameter and an outer diameter of said first ring, said adapter cage including a plurality of rails with each of said rails having a first end and a second end affixed between said first ring and said second ring and encircling a center axis of the launch tube with said rails further having a multitude of apertures radially positioned at a midpoint of said rails and with said apertures distributed longitudinally along a length of said rails;

an axle in each aperture and a wheel affixed to each said axle, each of said wheels having an integrated bearing with each said wheel capable of being positioned between an outer radius of the launch vehicle and the inside diameter of the launch tube, said plurality of wheels including a first wheel affixed at the first end of each said rail and a second wheel affixed to the second end of each said rail; and a linkage rod corresponding to each rail with each said linkage rod positioned parallel to each said rail and having a length exceeding a distance between said first wheel affixed at the first end of each said rail and said second wheel affixed to the second end of each said rail and said linkage rods affixed to said plurality of wheels associated with one rail wherein each of said linkage rods is capable of synchronizing a rotational motion of said plurality of wheels.

2. The adapter assembly in accordance with claim 1, wherein said wheels are manufactured from a deformable material.

3. A launcher assembly for accelerating a launch vehicle from rest to launch, said launcher assembly comprising:

a cylindrical launch tube having a closed end and an open end and having an inside diameter and having an inner surface;

a cylindrical pusher plate positioned coaxially in the inside diameter of said launch tube, said pusher plate having an outer circumference less than the inside diameter of said launch tube with said pusher plate having a circumferential seal to form an air-tight barrier between a breech chamber formed by said pusher plate and the closed end of said launch tube and a launch tube volume formed between said pusher plate and the open end of said launch tube wherein said pusher plate is able to move axially within said launch tube;

a compressed air tank fluidly connected to said breech chamber of said launch tube;

a muzzle closure cap covering the open end of said launch tube, said muzzle closure cap having a circumferential seal at an outer circumference to form an air-tight barrier in the launch tube volume;

a plurality of shear pins passing through said cylindrical launch tube and into the outer circumference of said muzzle closure cap for securing said muzzle closure cap to said launch tube;

an adapter cage having a first ring positioned coaxially to said launch tube to be in contact with said pusher plate within the launch tube volume, a second ring coaxially facing said first ring and in contact with said muzzle cap and said second ring having an inner diameter and an outer diameter equal to an inner diameter and an outer diameter of said first ring, said adapter including a plurality of rails with each of said rails having a first end and a second end affixed between said first ring and said second ring and encircling a center axis of said launch tube with said rails further having a multitude of apertures radially positioned at a midpoint of said rails and with said apertures distributed longitudinally along a length of said rail;

an axle in each aperture and a wheel affixed to each said axle, each of said wheels having an integrated bearing with each said wheel capable of being positioned between an outer radius of said launch vehicle and the inside diameter of said launch tube, said wheels comprising a first wheel affixed at the first end of each said rail and a second wheel affixed to the second end of each said rail; and a linkage rod corresponding to each rail with each said linkage rod positioned parallel to each said rail and having a length exceeding a distance between said first wheel affixed at the first end of each said rail and said second wheel affixed to the second end of each said rail and said linkage rods affixed to said plurality of wheels associated with one rail wherein each of said linkage rods is capable of synchronizing a rotational motion of said wheels;

wherein air released from said compressed air tank pressurizes the breech volume to press on said pusher plate and cause said pusher plate and said adapter cage to move away from said closed end of said launch tube, the movement of said adapter cage causes said wheels to roll on the inner surface of said launch tube such that the rotation transfers motion to the launch vehicle, said motion of said adapter cage also forces said adapter cage against said muzzle cap closure, the force acting to shear said shear pins and to force said muzzle cap from the end of said launch tube to allow said launch vehicle to launch.

4. The launcher assembly in accordance with claim 3, said launcher assembly further comprising a servo valve between said compressed air tank and the breech volume wherein said servo valve is capable of controlling an amount of compressed air from said compressed air tank to said launch tube.

5. The launcher assembly in accordance with claim 4, said launcher assembly further comprising a plurality of pins positioned integral to said wheels with said pins extending beyond a surface of said wheels.

6. The launcher assembly in accordance with claim 5, wherein said wheels are manufactured from a deformable material.

* * * * *